US005437209A

United States Patent [19]

Santoro

[11] Patent Number: 5,437,209

[45] Date of Patent: Aug. 1, 1995

[54] ROCKER ARM ASSEMBLY

[75] Inventor: Robert V. Santoro, West Hartford, Conn.

[73] Assignee: The Torrington Company, Torrington, Conn.

[21] Appl. No.: 129,831

[22] Filed: Sep. 30, 1993

[51] Int. Cl.[6] ..... G05G 1/00; F01L 1/18

[52] U.S. Cl. ..... 74/559; 74/519; 123/90.39; 123/90.41; 384/581; 384/558

[58] Field of Search ..... 123/90.39, 90.41; 74/519, 559; 384/558, 581, 905.1

[56] References Cited

U.S. PATENT DOCUMENTS

| | | | |
|---|---|---|---|
| Re. 33,870 | 4/1992 | Fittro et al. | 123/90.41 |
| 3,251,350 | 5/1966 | Thompson | 123/90.41 |
| 3,466,073 | 9/1969 | Pohle | 123/90.39 |
| 3,621,823 | 11/1971 | Lombardi | 123/90.42 |
| 4,314,732 | 2/1982 | Murphy | 123/90.41 |
| 4,577,911 | 3/1986 | Fredericksen et al. | 308/2 R |
| 4,674,453 | 6/1987 | Dove, Jr. | 123/90.39 |
| 4,697,473 | 10/1987 | Patel | 123/90.39 |
| 4,718,379 | 1/1988 | Clark | 123/90.39 |
| 4,724,802 | 2/1988 | Ishii | 123/90.39 |
| 4,727,832 | 3/1988 | Miyamura et al. | 123/90.39 |
| 4,858,575 | 8/1989 | Fittro et al. | 123/90.41 |
| 4,878,463 | 11/1989 | Fredericksen et al. | 123/90.41 |
| 4,896,635 | 1/1990 | Willermet et al. | 123/90.41 |
| 4,944,257 | 7/1990 | Mills | 123/90.39 |
| 4,967,705 | 11/1990 | Maciag et al. | 123/90.48 |
| 5,074,261 | 12/1991 | Hamburg et al. | 123/90.39 |
| 5,195,475 | 3/1993 | Murphy et al. | 123/90.39 |
| 5,297,509 | 3/1994 | Murphy | 123/90.41 |
| 5,313,916 | 5/1994 | Murphy | 123/90.39 |
| 5,329,891 | 7/1994 | Murphy et al. | 74/559 X |

FOREIGN PATENT DOCUMENTS

| | | | |
|---|---|---|---|
| 5-280318 | 10/1993 | Japan | 123/90.39 |

*Primary Examiner*—Vinh T. Luong
*Attorney, Agent, or Firm*—John C. Bigler

[57] ABSTRACT

Two support arms of a bearing support member extend in opposite directions, each support arm having an overlying bearing cup engageable with a rocker arm. A bearing sleeve is mounted over each support arm between the respective bearing cup and the bearing support member to provide an inner raceway. Each bearing sleeve has sufficient radial clearance with respect to the respective support arm such that the bearing sleeve precesses with oscillation of the rocker arm. Rolling members within an annulus formed between the bearing support member and each bearing cup allow the rocker arm to freely oscillate rotatably with respect to the bearing support member.

16 Claims, 3 Drawing Sheets

ROCKER ARM ASSEMBLY

BACKGROUND OF THE INVENTION

This invention relates generally to valve operating mechanisms for use in internal combustion engines and, more particularly, to an oscillating rocker arm assembly and subassembly having rolling members.

Typically, a rocker arm assembly with rolling members is supported on a support shaft mounted perpendicularly on a support stud extending from the head of the engine. The rocker arm is pivoted on the support shaft, which serves as an inner raceway, by means of drawn cup needle roller bearings mounted on the rocker arm. Alternatively, a bearing sleeve may be mounted on the support shaft to provide the inner raceway, permitting use of a non-cylindrical support arm and facilitating the use of powder metal forming.

When bearing sleeves are used in such rocker arm assemblies to provide the inner raceway, fatigue, spalling, wear or other damage to the bearing sleeves may limit the useful life of the rocker arm assemblies. Such damage is exacerbated by the directional loading on the lower portion of the bearing sleeve, that is, that portion of the bearing sleeve nearest the engine head. Accordingly, there is a need to provide a rocker arm assembly that reduces such damage to the bearing sleeves and thereby extends the useful life of the rocker arm assembly.

The foregoing illustrates limitations known to exist in present rocker arm bearing assemblies. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a rocker arm assembly comprising a rocker arm and a bearing support member, mountable about a stud means. Two support arms of the bearing support member extend in opposite directions. Each support arm has an overlying bearing cup engageable with the rocker arm. A bearing sleeve is mounted over each support arm between the respective bearing cup and the bearing support member to provide an inner raceway. Each bearing sleeve has sufficient radial clearance with respect to the respective support arm such that the bearing sleeve precesses with oscillation of the rocker arm. Rolling members within an annulus formed between the bearing support member and each bearing cup allow the rocker arm to freely oscillate rotatably with respect to the bearing support member.

In another aspect of the present invention, this is accomplished by providing a bearing assembly for mounting within a rocker arm.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
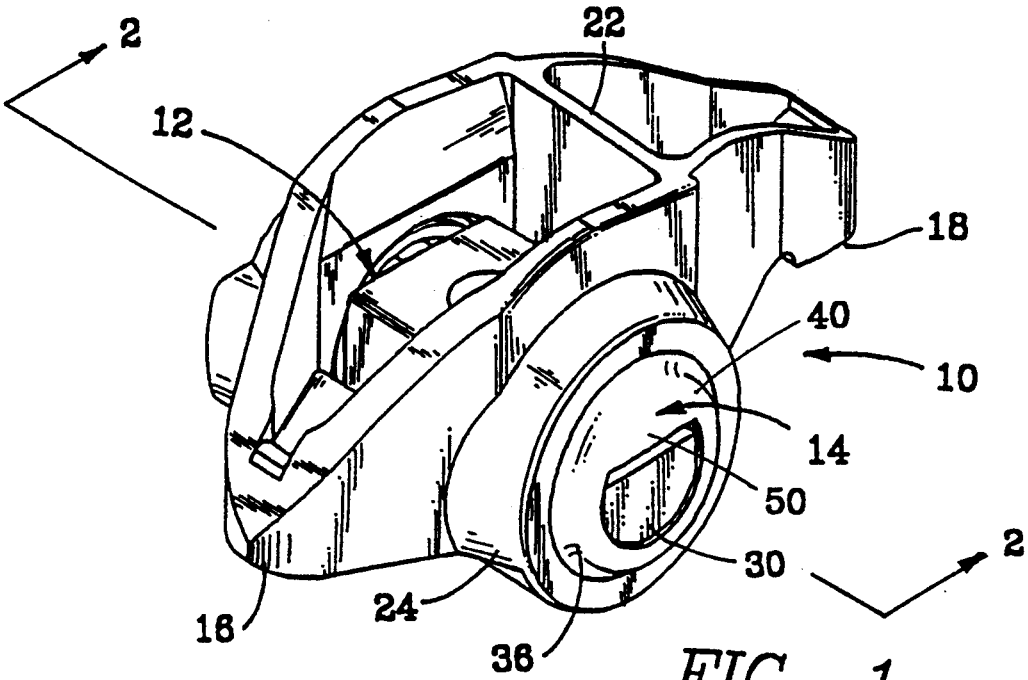
FIG. 1 is a pictorial view illustrating a first embodiment of the rocker arm assembly of the present invention.

Referring now to the drawings, FIG. 1 illustrates a first embodiment of the present invention having rocker arm 10 supported on bearing support member 12 by roller bearings 14 to form a rocker arm assembly as would be used in an internal combustion engine.

Rocker arm 10 has first end 16 for engagement with a push rod, not shown, and second end 18 for engagement with a valve stem of a poppet valve, not shown. The rocker arm assembly is mounted on the engine by a stud, cap screw or other stud means 20, indicated in phantom in FIG. 2. In the embodiment shown, rocker arm 10 is of a cast configuration including reinforcing web 22 and flanges 24, providing added rigidity. However, the rocker arm assembly of the present invention may be employed with stamped or cast rocker arms of various configurations.

Figure 2:
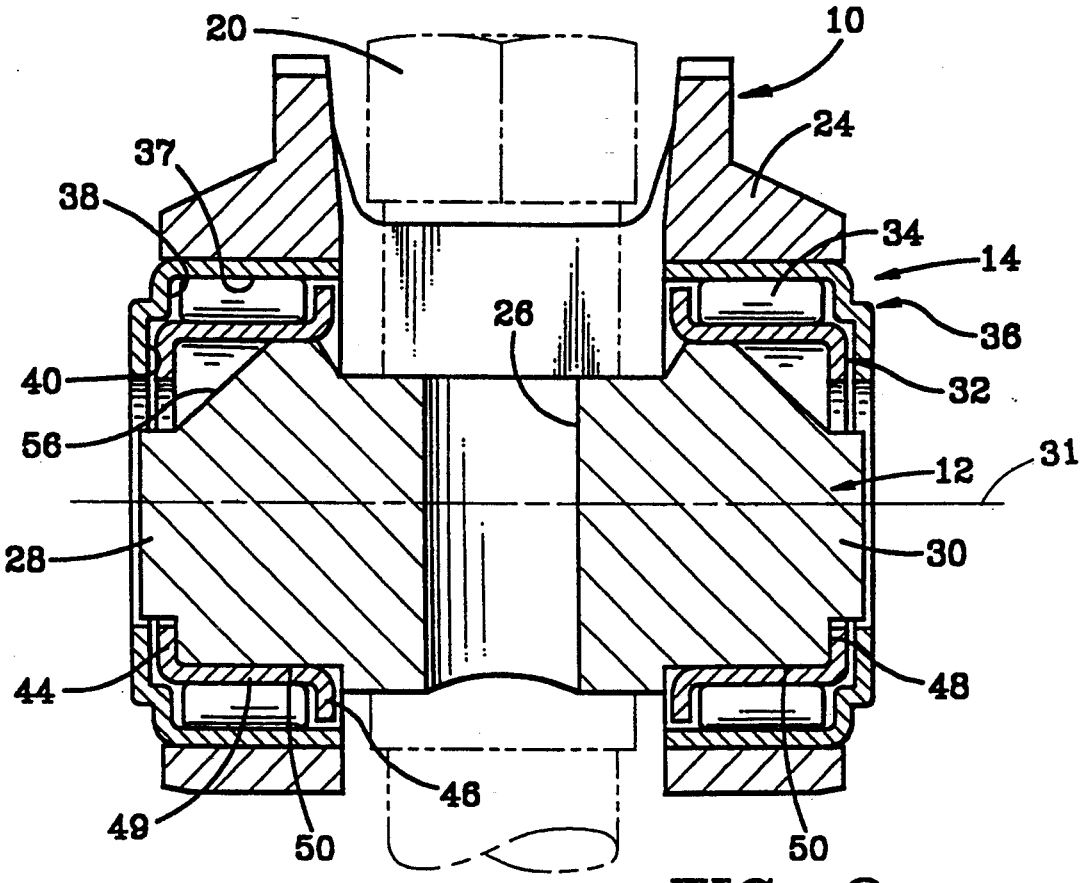
FIG. 2 is an enlarged cross sectional view of the rocker arm assembly of FIG. 1.

As illustrated in FIG. 2, bearing support member 12 has a substantially vertical bore 26 for receiving stud means 20 to mount the rocker arm assembly. Bearing support member 12 has support arms 28 and 30 which extend in opposite directions along common axis 31 perpendicular to stud means 20. Roller bearings 14 are mounted along that axis over support arms 28 and 30 by inner bearing sleeves 32 which provide inner raceways for rolling members 34. Roller bearings 14 may employ a full complement of needle rollers or may employ other types of rolling members 34, with or without retainers.

Rolling members 34 are within an annulus formed between inner sleeves 32 and bearing cups 36. Bearing cups 36 have a common axis and are rigidly mounted on two spaced apart side portions of rocker arm 10 by any of various fixing means. In the embodiment shown, for example, apertures in the side portions provide an interference fit with bearing cups 36. Bearing support member 12 has a cross-section smaller than the apertures in the side portions of rocker arm 10, thus allowing bearing support member 12 to be inserted through one of the apertures during assembly.

Bearing cups 36 are of the "open" type. That is, the bearing cups have a bottom surface, cylindrical side surfaces 37, and an open top. The bottom surface is "stepped" that is, a radially inwardly extending first portion 38 and a radially inwardly extending second portion 40 axially offset from first portion 38. First portion 38 is engageable with ends of rolling members 34 to limit outward axial movement of the rolling members, and second portion 40 is engageable with a stop surface of bearing sleeves 32 or support arms 28 and 30 to limit axial movement of rocker arm 10 with respect to bearing support member 12.

Bearing sleeves 32 may be formed with outwardly extending flanges 46 that are engageable with ends of rolling members 34 to limit axial movement toward stud means 20. Inwardly extending flanges 44 abut recessed end surfaces 48 of support arms 28 and 30 to ensure proper axial location of inwardly extending flanges 44. Cylindrical portion 50 of bearing sleeves 32 provides an inner raceway for rolling members 34 and facilitates use of powder metal forming of bearing support member 12 by allowing support arms 28 and 30 to have a noncylindrical configuration, as described below.

As shown in FIG. 1, second portion 40 of bearing cups 36 may have a modified D-shaped opening or other keyway means 50 for receiving D-shaped end or other key means of bearing support member 12. The purpose of the keyway and key means is to ensure that bearing support member 12 is assembled into rocker arm 10 with the proper orientation, that is, that bearing support member 12 is not inadvertently "upside down". During assembly, bearing support member 12 with bearings 14 can be conveniently inserted into rocker arm 10 by a machine that uniformly positions keyway means 50 with respect to rocker arm 12.

Figure 3:
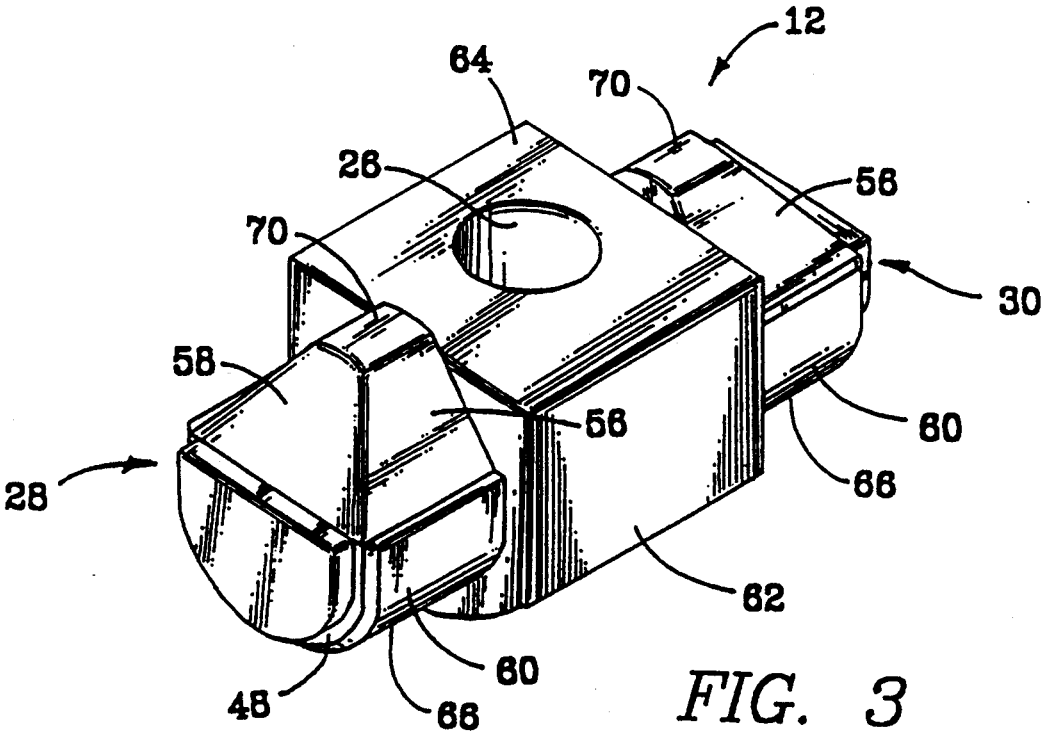
FIG. 3 is a pictorial view of the bearing support member of the rocker arm assembly of FIG. 1.

Bearing support member 12 may be cylindrical or may include beveled surfaces 56 and 58 and flat side surfaces 60 and 62, as shown in FIG. 3. Those beveled and flat surfaces facilitate manufacture of bearing support member 12 by powder metal forming. Because rolling members 34 ride on an inner raceway provided by bearing sleeves 32, and because the greatest force is on the lower portion of roller bearings 14, the portion nearest the engine head, those beveled and flat surfaces on the top and side portions of bearing support member 12 do not affect operation of the rocker arm assembly.

Bearing support member 12 and roller bearings 14 may form a subassembly having a generally cylindrical configuration. Because central portion 64 of bearing support member 12 has a smaller cross-section (smaller overall diameter) than that of bearing cups 36, the subassembly may be inserted laterally into the apertures of the side portions of rocker arm 10 while bearing cups 36 being are press-fit therein. Alternatively, bearing cups 36 may be inserted from opposite sides of rocker arm 10.

In present rocker arm assemblies of the general configuration just described, the bearing sleeves are rigidly mounted on the support arms of the bearing support member. Such rigid mounting prevents any rotation of the bearing sleeves with respect to the bearing support arm. Because the bearing sleeves are unable to rotate, fatigue, spalling, wear or other damage is concentrated in the loaded portion of the bearing sleeves, typically the lower portion of the bearing sleeves, the portion nearest the engine head.

In the rocker arm assembly of the present invention, each bearing sleeve 32 has sufficient radial clearance with respect to the respective support arm, 28 or 30, such that bearing sleeve 32 precesses with oscillation of rocker arm 10. That is, the normal oscillating operation of rocker arm 10 results in an incremental rotation of bearing sleeve 32. This precessing moves the loaded portion of bearing sleeve 32 circumferentially to a new region of the bearing sleeve, thereby distributing fatigue stress and wear over the full circumference of bearing sleeve 32.

The optimum radial clearance is dependent upon the size of rocker arm 10, the force of the springs holding rocker arm 10 against bearing support member 12, and other aspects of the particular rocker arm assembly installation. For a typical automobile rocker arm of the type illustrated in FIGS. 1 through 3, a difference between the inside diameter of bearing sleeves 32 and the outside diameter of support arms 28 and 30 of between 0.000 inch and 0.003 inch has been found particularly satisfactory. However, a diameter difference of 0.005 inch or even larger would achieve similar results in many applications.

Figure 4:
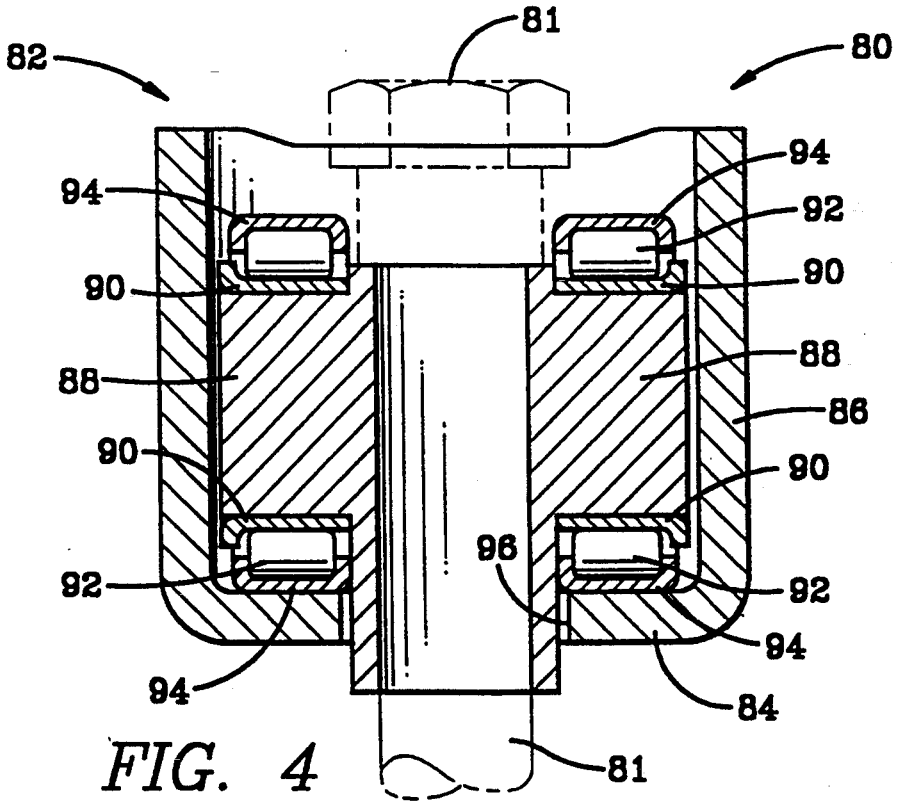
FIG. 4 is a cross sectional view illustrating a second embodiment of the rocker arm assembly of the present invention.
Figure 5:
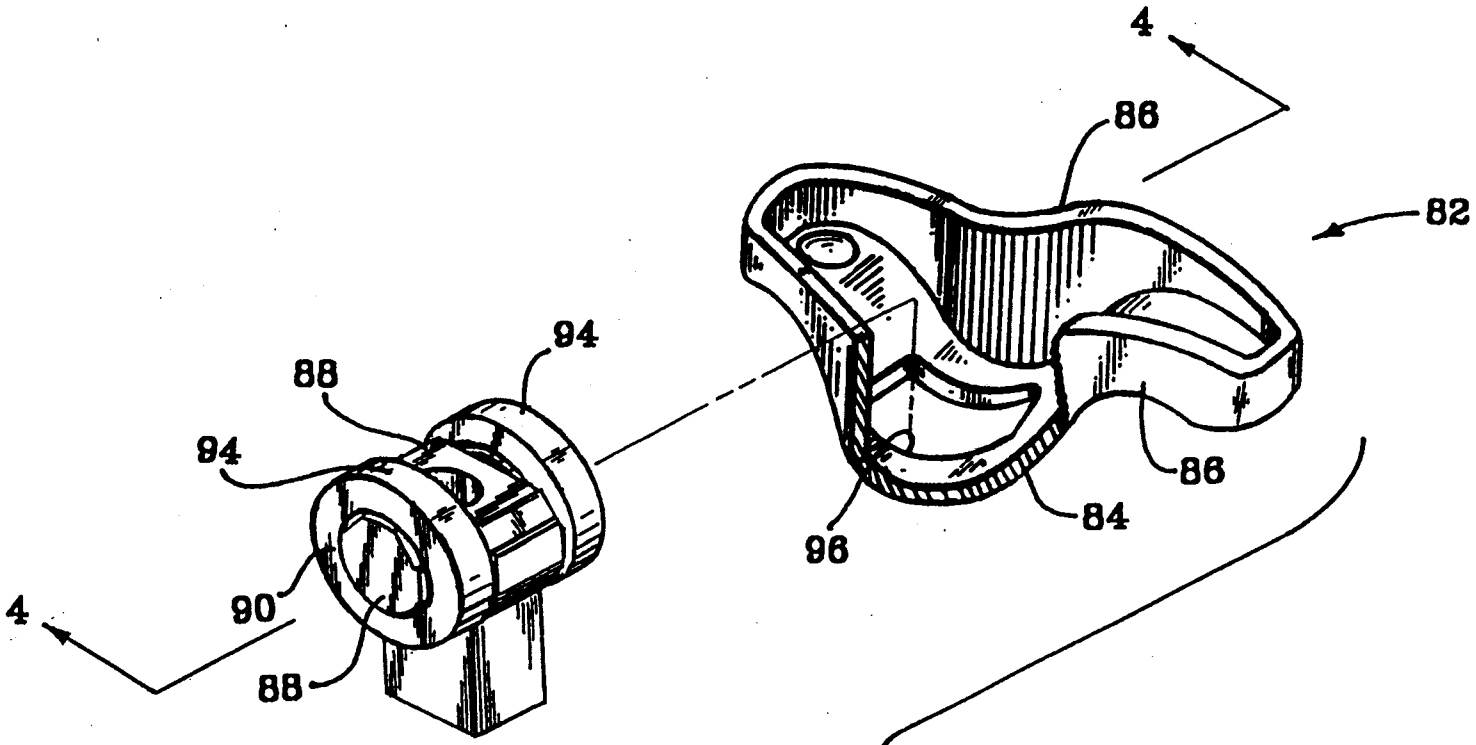
FIG. 5 is an exploded pictorial view, with a portion cut away, of the embodiment of FIG. 4 of the present invention.

The particular advantages of the precessing bearing sleeve of the present invention are not limited to a rocker arm assembly having a support arm and roller bearings mounted in a transverse bore of a rocker arm. In addition, for example, a precessing bearing sleeve can be incorporated in a "drop in" type rocker arm assembly similar to that described in U.S. Pat. No. Re. 33,870. Such rocker arm assembly, defining a second embodiment of the present invention, is illustrated in FIGS. 4 and 5, in relation to stud means 81, indicated in phantom.

In this embodiment, rocker arm 82 has a "bath tub-shaped" configuration formed by lower portion 84 and side walls 86 extending upward therefrom. Bearing support member 88, with bearing sleeves 90, rolling members 92, and bearing cups 94, is inserted downwardly (hence, the term "drop in") as a subassembly into rocker arm 82 such that bearing support member 88 extends into elongated aperture 96. As indicated in FIG. 5, bearing support member 88 has relief areas similar to those of bearing support member 12 shown in FIG. 3 to facilitate powder metal forming.

Bearing sleeves 90 have sufficient radial clearance with respect to bearing support member 88 such that bearing sleeves 90 precess with normal oscillating operation of rocker arm 82. This incremental rotation of bearing sleeves 88 moves the loaded portion of bearing sleeves 88 circumferentially, thereby distributing fatigue stress and wear. For a typical automobile rocker arm assembly of this type, a diameter difference of 0.000 inch to 0.008 inch has been found particularly satisfactory, although a diameter difference of 0.015 inch or more may also be used.

From the above, it will be apparent that the present invention provides an improved rocker arm assembly by minimizing the fatigue cycles in any one arc of the bearing sleeve circumference. As a result, the life of the bearing sleeve is increased, extending the useful life of the rocker arm assembly. The present invention is applicable to a wide variety of rocker arm assemblies.

Having described the invention, what is claimed is:

1. A rocker arm assembly for mounting about a stud means, the rocker arm assembly comprising:

a rocker arm;

a bearing support member having two support arms extending in opposite directions along an axis, the bearing support member being adapted for mounting about the stud means;

two bearing cups, one bearing cup extending over each support arm and engaging the rocker arm;

two bearing sleeves, one bearing sleeve mounted over each support arm between the respective bearing cup and the bearing support member to provide an inner raceway, each bearing sleeve having radial clearance with respect to the respective support arm such that the bearing sleeve precesses relative to the respective support arm with oscillation of the rocker arm; and rolling members within an annulus formed between the bearing support member and each bearing cup, in rolling contact with the bearing cup such that the rocker arm is rotatable with respect to the bearing support member.

2. The rocker arm assembly according to claim 1, wherein the radial clearance between the bearing sleeve and the respective support arm is a diameter difference between 0.000 inch and 0.015 inch.

3. The rocker arm assembly according to claim 1, wherein the bearing cups are rigidly mounted on the rocker arm.

4. The rocker arm assembly according to claim 3, wherein the radial clearance between the bearing sleeve and the respective support arm is a diameter difference between 0.000 inch and 0.005 inch.

5. The rocker arm assembly according to claim 1, wherein each bearing sleeve includes a flange extending radially inwardly with respect to the bearing support member axis and engaging the bearing support member.

6. The rocker arm assembly according to claim 1, wherein each bearing sleeve includes a flange extending radially outwardly with respect to the bearing support member axis such that axial movement of the rolling members is limited.

7. The rocker arm assembly according to claim 1, wherein each bearing sleeve includes a flange on one end extending radially inwardly with respect to the bearing support member axis and a flange on the opposite end of said bearing sleeve extending radially outwardly with respect to the bearing support member axis.

8. The rocker arm assembly according to claim 1, wherein at least one bearing cup includes keyway means for engaging key means on the respective support arm to limit orientation therebetween.

9. The rocker arm assembly according to claim 1, wherein the rocker arm has a generally bath tub-shaped configuration having a lower portion and at least two side walls extending upward therefrom and wherein a loaded portion of each bearing cup engages the lower portion of the rocker arm.

10. The rocker arm assembly according to claim 9, wherein the radial clearance between the bearing sleeve and the respective support arm is a diameter difference between 0.000 inch and 0.015 inch.

11. A bearing assembly for mounting within a rocker arm, the bearing assembly comprising:

a bearing support member having two support arms extending in opposite directions along an axis, the bearing support member being adapted for mounting about the stud means;

two bearing cups, one bearing cup extending over each support arm and engaging with the rocker arm;

two bearing sleeves, one bearing sleeve mounted over each support arm between the respective bearing cup and the bearing support member to provide an inner raceway, each bearing sleeve having sufficient radial clearance with respect to the respective support arm such that the bearing sleeve precesses relative to the support arm with oscillation of the rocker arm; and rolling members within an annulus formed between the bearing support member and each bearing cup, in rolling contact with the bearing cup such that the rocker arm is rotatably with respect to the bearing support member.

12. The rocker arm assembly according to claim 11, wherein the radial clearance between the bearing sleeve and the respective support arm is a diameter difference between 0.000 inch and 0.015 inch.

13. The rocker arm assembly according to claim 11, wherein each bearing sleeve includes a flange extending radially inwardly with respect to the bearing support member axis and engaging the bearing support member.

14. The rocker arm assembly according to claim 11, wherein each bearing sleeve includes a flange extending radially outwardly with respect to the bearing support member axis such that axial movement of the rolling members is limited.

15. The rocker arm assembly according to claim 11, wherein each bearing sleeve includes a flange on one end extending radially inwardly with respect to the bearing support member axis and a flange on the opposite end of said bearing sleeve extending radially outwardly with respect to the bearing support member axis.

16. The rocker arm assembly according to claim 11, wherein at least one bearing cup includes keyway means for engaging key means on the respective support arm to limit orientation therebetween.

* * * * *